US007810178B2

(12) United States Patent
Wajda

(10) Patent No.: US 7,810,178 B2
(45) Date of Patent: Oct. 12, 2010

(54) DUAL TOILET TANK SYSTEM

(76) Inventor: George J. Wajda, 4070 Illinois St., San Diego, CA (US) 92104-2616

( * ) Notice: Subject to any disclaimer, the term of this patent is extended or adjusted under 35 U.S.C. 154(b) by 271 days.

(21) Appl. No.: 12/232,155

(22) Filed: Sep. 11, 2008

(65) Prior Publication Data

US 2010/0058521 A1 Mar. 11, 2010

(51) Int. Cl.
*E03D 5/00* (2006.01)

(52) U.S. Cl. ..... 4/346; 4/345; 4/324; 4/326

(58) Field of Classification Search ..... 4/346, 4/345, 324, 326

See application file for complete search history.

(56) References Cited

U.S. PATENT DOCUMENTS

| | | | |
|---|---|---|---|
| 3,894,299 | A | 7/1975 | Cleary |
| 4,371,993 | A | 2/1983 | Patrick |
| 5,067,180 | A | 11/1991 | Figeroid |
| 5,117,513 | A | 6/1992 | Burrowes |
| 5,261,129 | A | 11/1993 | Roy |
| 5,495,624 | A | 3/1996 | Lisook et al. |
| 5,711,039 | A | 1/1998 | Mizrahi |
| 5,873,136 | A | 2/1999 | Geeham |
| 5,887,292 | A | 3/1999 | Goren |
| 6,317,899 | B1 | 11/2001 | Brewer |
| 2002/0157177 | A1 | 10/2002 | Sakura |

*Primary Examiner*—Gregory L Huson
*Assistant Examiner*—Karen Younkins
(74) *Attorney, Agent, or Firm*—Richard C. Litman

(57) ABSTRACT

The dual toilet tank system is toilet flushing system that efficiently uses the water in the tank depending on the waste being flushed. The tank body has a divider separating the tank into two compartments, one compartment has a smaller volume than the other; a flushing valve assembly with two flapper valves, one flapper valve disposed vertically higher than the other with each disposed in respective compartments; and independently operated actuators that flush the water in respective compartments or all of the tank. The smaller volume compartment is mostly used for liquid wastes while the larger volume compartment is used for solid wastes. For larger loads, both compartments are utilized.

15 Claims, 7 Drawing Sheets

DUAL TOILET TANK SYSTEM

BACKGROUND OF THE INVENTION

1. Field of the Invention

The present invention relates to a toilet flushing system. More specifically, the invention is a dual toilet tank system that efficiently uses, and considerably reduces, the amount of water used to flush sewage and other wastes, which, in turn, saves the user on water and sewer bills and promotes water conservation.

2. Background of the Invention

Water consumption, potable or otherwise, can be costly to consumers depending on the demand. In many metropolitan areas, wastewater is recycled and the costs are passed to the consumer. In some areas of the world, water is a premium commodity because of geography, availability, economy and/or weather conditions. Modern toilets consume much of the available water, but they are very inefficient because the same amount of water is used to flush both liquid and solid wastes.

Thus, a dual toilet tank system solving the aforementioned problems is desired.

SUMMARY OF THE INVENTION

The dual toilet tank system includes a tank separated into two compartments by a divider, a flushing valve assembly spanning both compartments, and two flush valves disposed at different elevations with respect to the base of the tank. When flushing waste, this arrangement allows a small amount of water to be used for liquid waste, with the remaining water used for solid waste.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 6:
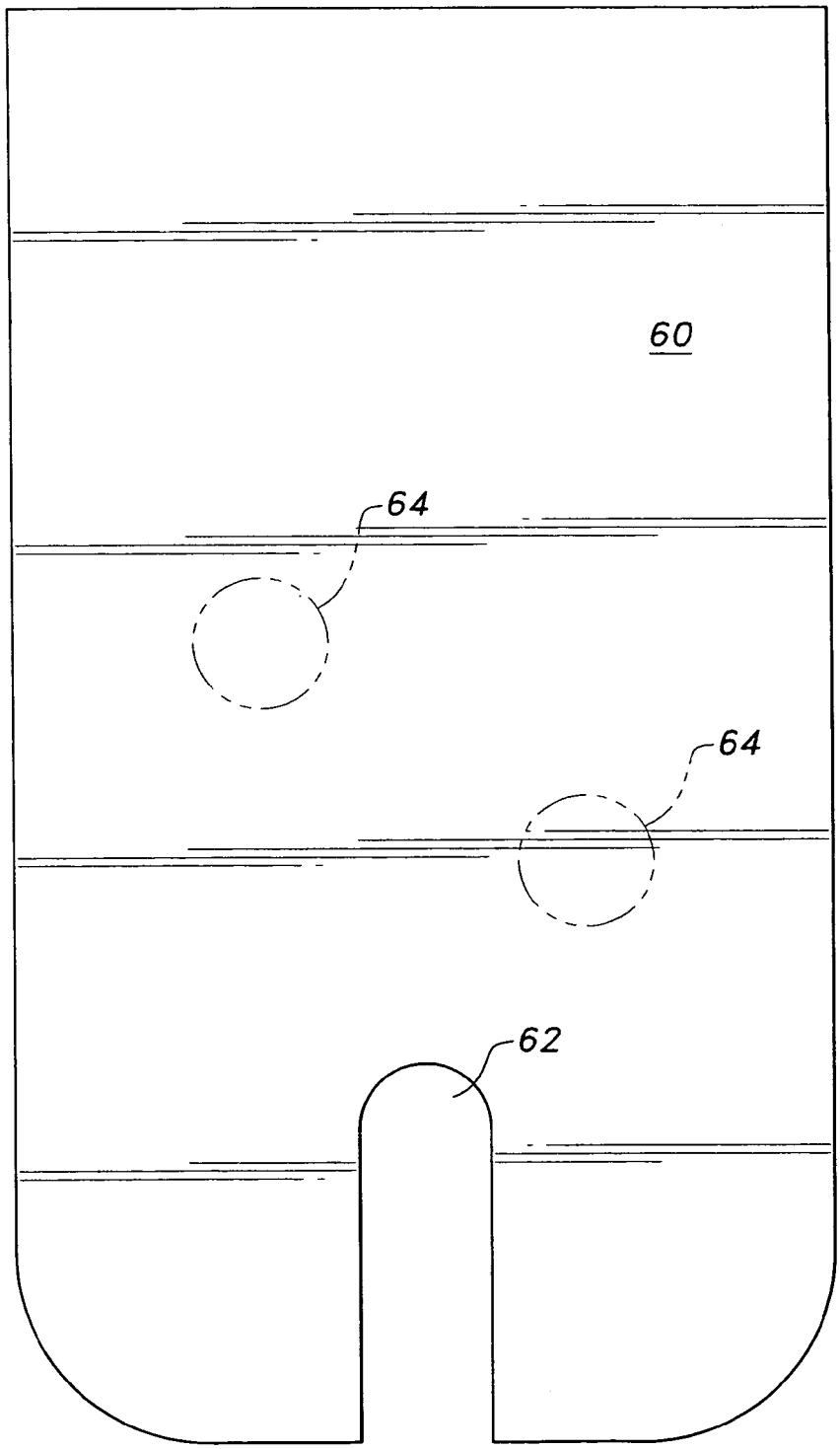
FIG. 6 is a front view of divider in the dual toilet tank system.
Figure 7:
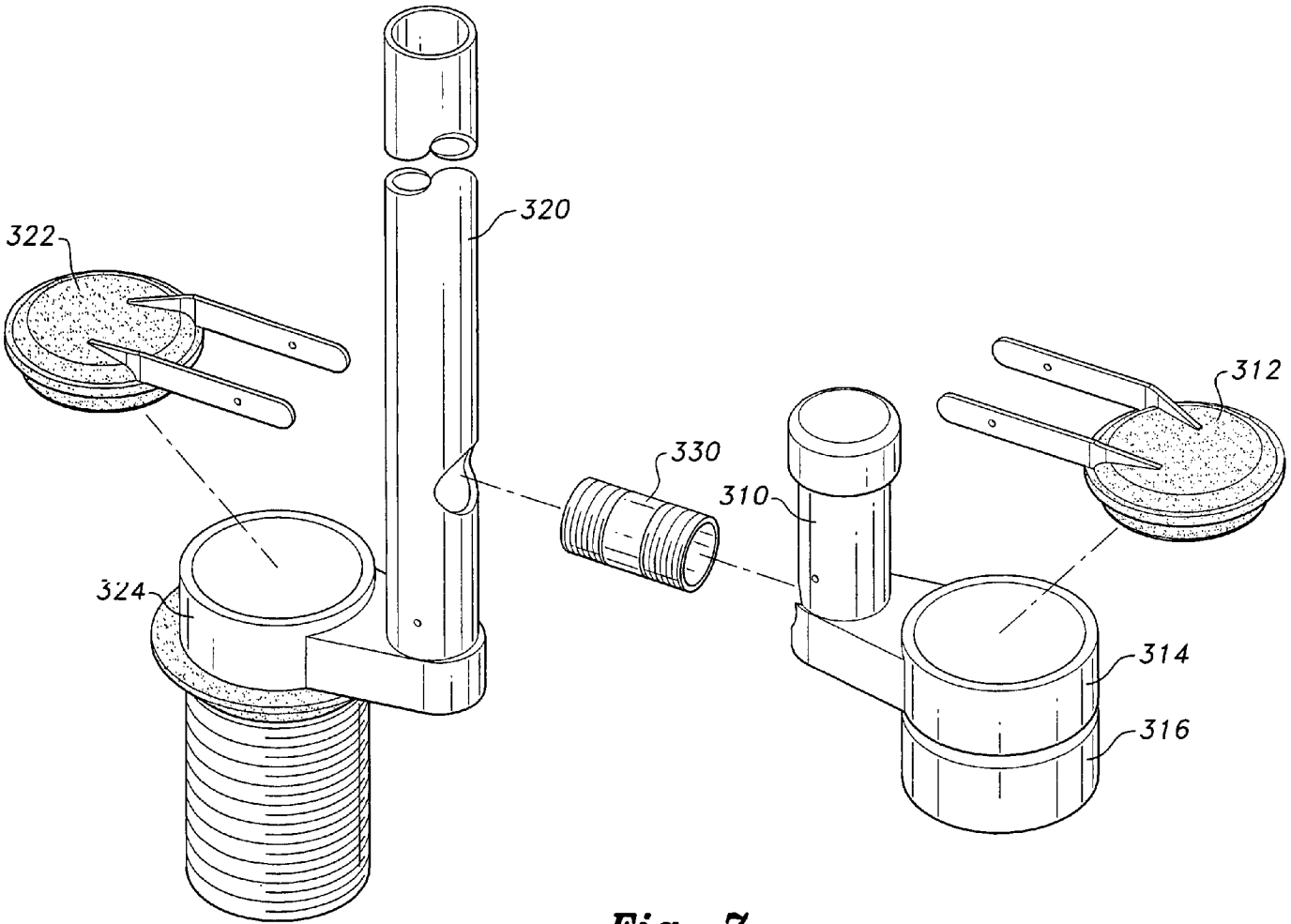
FIG. 7 is an exploded view of the flushing valve assembly of the dual toilet tank system.

The present invention relates to a dual toilet tank system that efficiently uses the water in the tank by selectively flushing predetermined amounts of water depending on the particular waste load. Referring to FIGS. 1-5, the dual toilet tank system includes a tank body 10, a divider 60 that separates the tank into compartments A and B, and a flushing valve assembly 300 that spans both compartments. When the tank is full, compartment A preferably contains approximately ⅓ of the total volume of water, while compartment B contains the remainder. The divider is a substantially flat piece of material sized and shaped to fit between opposing walls of the tank to define a dividing wall. The divider may be made from plastic or any other suitable, water-proof sturdy material. The bottom of the divider includes a slot 62 formed to fit over the connector tube 330 of the flushing valve assembly when the divider is inserted into the tank to form a friction or interference fit (best shown in FIG. 6). This slot also permits fluid communication between the two compartments. Exemplary dimensions of the slot include a width of approximately 2 cm. and a length of approximately 2.5 cm. The bottom of the tank is provided with bolts 12 to mount the tank to a standard toilet bowl.

Figure 1:
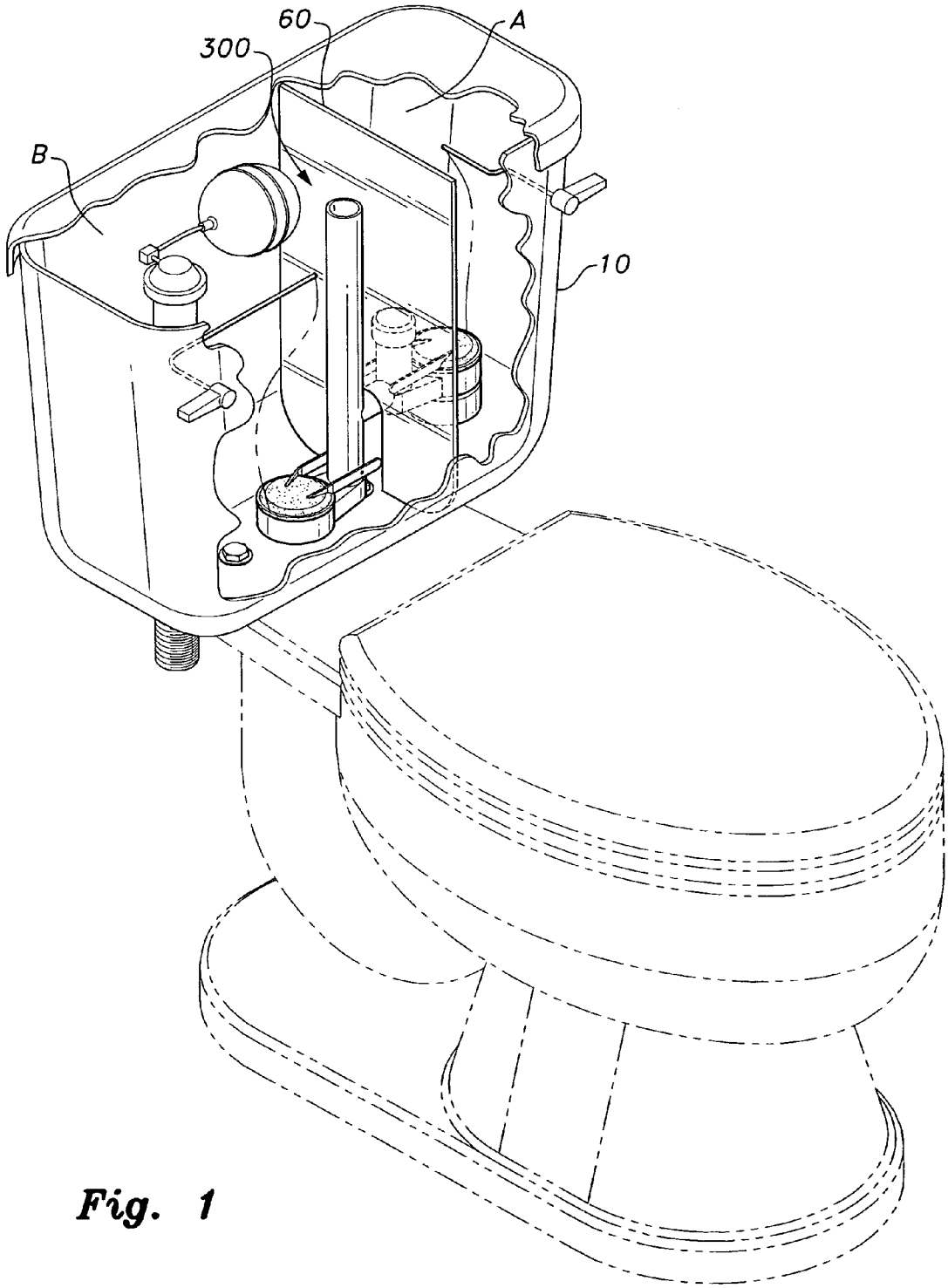
FIG. 1 is a partially cut-away, perspective view of a dual toilet tank system according to the present invention.
Figure 2:
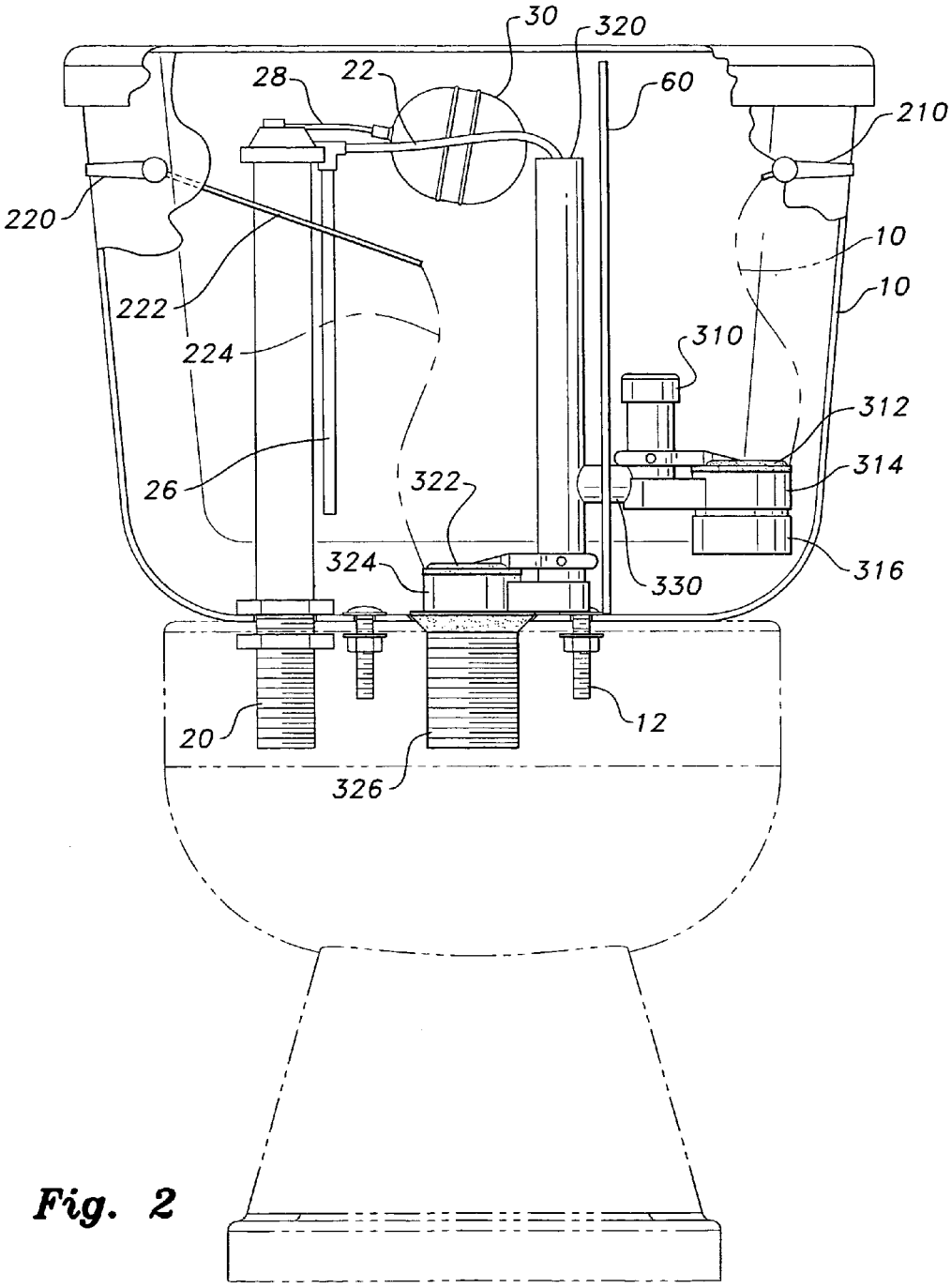
FIG. 2 is a sectional front view of the dual toilet tank system.
Figure 3:
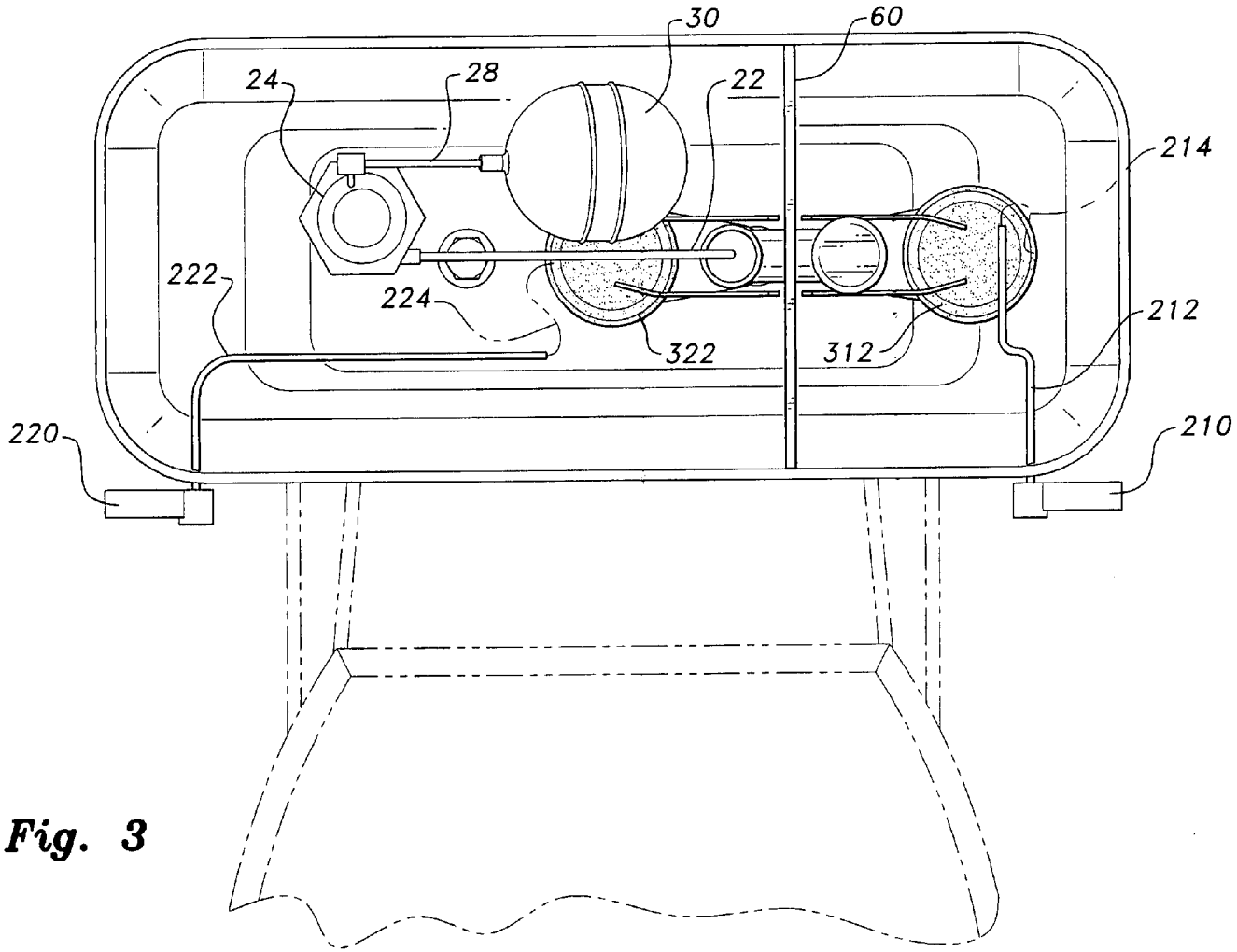
FIG. 3 is a sectional top view of the dual toilet tank system.
Figure 4:
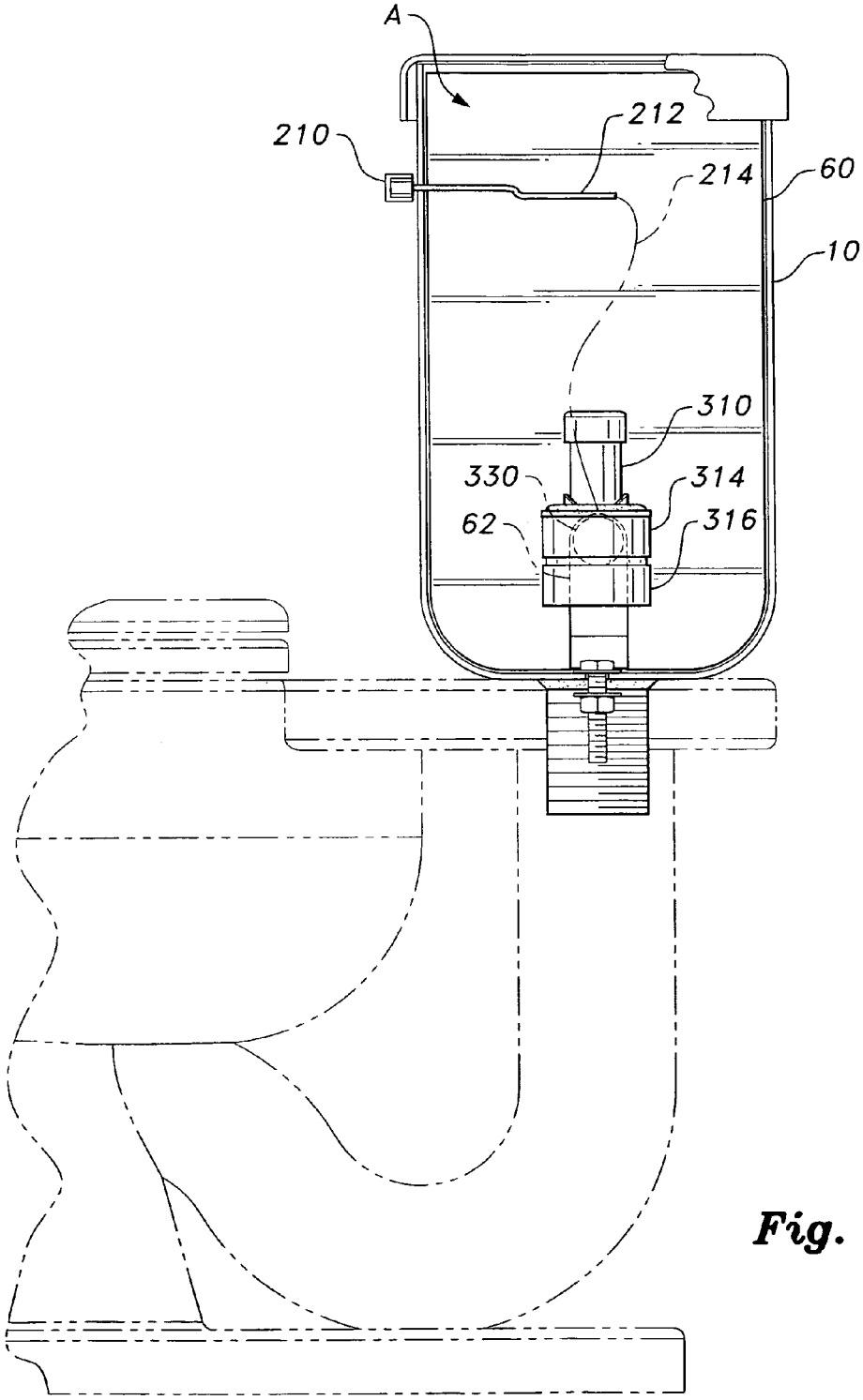
FIG. 4 is a side view of the dual toilet tank system showing one of the compartments.
Figure 5:
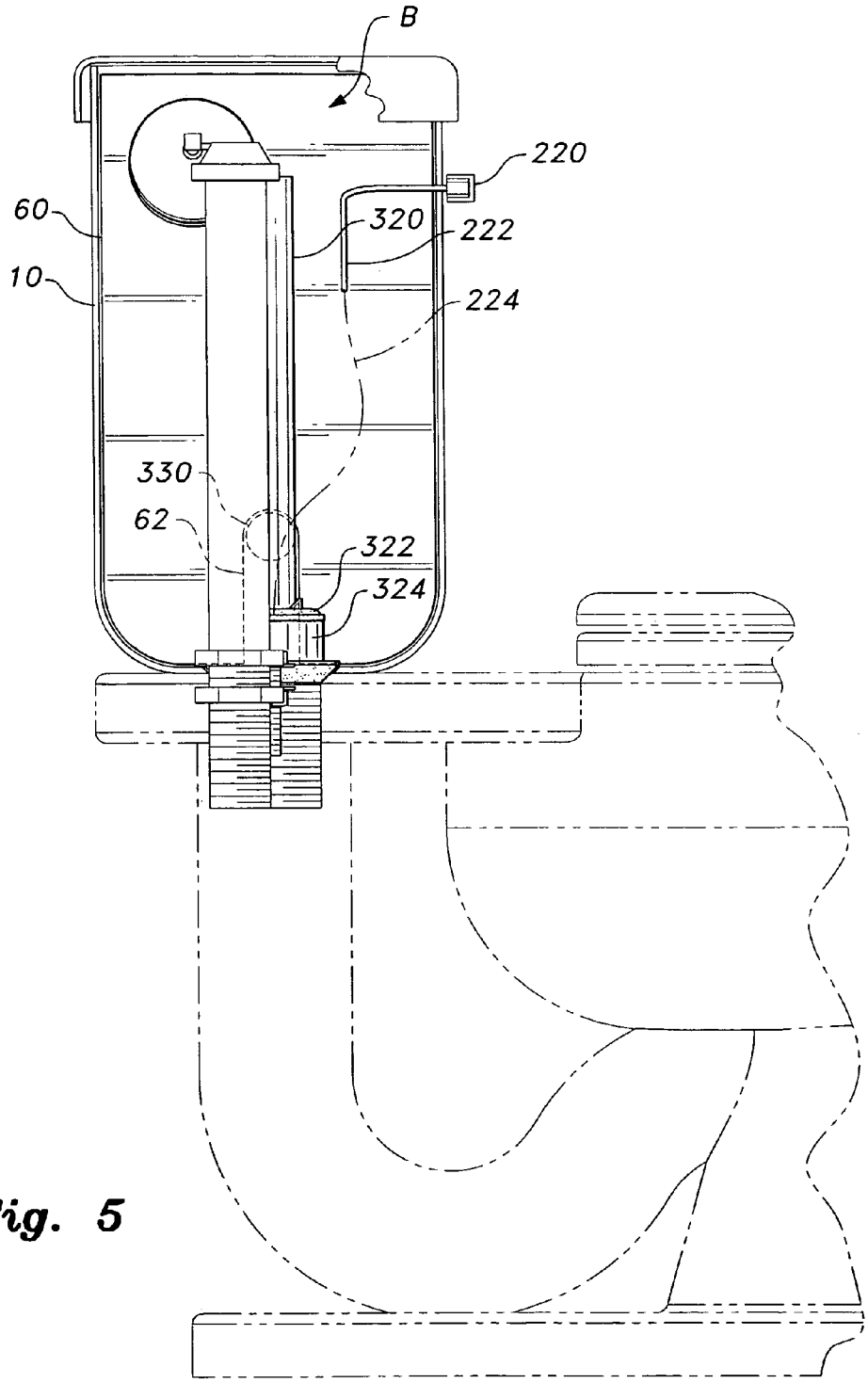
FIG. 5 is a side view of the dual toilet tank system showing the other compartment.

Referring to FIG. 2, the water is supplied through the main inflow tube 20 to the tank refill tube 22. The float 30, pivotably connected to the inlet valve 24, controls the flow of water. When the tank is empty, the float hangs from its connection to the inlet valve, which opens the same. As the tank fills, the float rises and gradually closes the inlet valve as the float reaches a predetermined level. The float arm 28 is shorter in length than a conventional float arm to insure that the float does not encounter interference by the divider and remains on the side of compartment B. A filter tube 26 is also disposed near the inlet valve.

The flushing valve system includes an elongated overflow tube 320 connected to two flush assemblies disposed on either side of the overflow tube. The flush assembly on the compartment A side is composed of a first flapper valve housing 314 with an opening at the top end thereof to accommodate a first flapper 312. A cap 316 closes the bottom end of the housing to prevent leakage of the water flowing through the housing. An L-shaped tube 310 extends from the housing 314, and the first flapper 312 is pivotably connected to the L-shaped tube. The top end of the L-shaped tube is also closed. Extending perpendicularly from the bottom of the overflow tube is the second flush valve housing 324 for the compartment B side. The second flush valve housing has an opening at the top end thereof to accommodate a second flapper 322. The second flapper is pivotably connected to the overflow tube. Although this embodiment shows the pivotable connections of the first and second flappers at the respective tubes, other locations are also possible as long as they allow the flappers to move between closed and open positions.

The bottom end of the second valve housing extends downwardly to form an outlet shaft 326. The outlet shaft is threaded to permit connection to the discharge passageway of a standard toilet bowl. The overflow tube and the L-shaped tube each have a threaded bore, one near the bottom for the overflow tube and the other at the juncture of the L-shape for the L-shaped tube. A hollow threaded connector 330 is provided to fasten the two tubes together. When the flushing valve system is assembled, the first flapper valve is disposed at a higher elevation from vertical; i.e., higher with respect to the bottom of the tank, than the second flapper valve.

Respective actuators operate each flapper valve independently. The actuator for the first flapper valve includes a first handle 210 fastened to a first lever arm 212. One end of an adjustable chain 214 connects to the distal end of the first lever arm, and the other end of the chain connects to the first flapper. The actuator for the second flapper valve is similarly arranged with a second handle 220, second lever arm 222 and an adjustable chain 224. Each lever arm is of a length suitable for the size of the respective compartments.

Next, the operation of the dual toilet tank assembly will be described. As mentioned above, the divider separates the tank into compartments A and B. Compartment A contains the lowest amount of water; i.e., about ⅓ of the tank capacity. Moreover, the water in compartment A will also be the most utilized since toilets are more often used for liquid wastes than solid. When a user desires to eliminate liquid waste, the user operates the first handle 210 to open the first flapper valve via the first lever arm 212 lifting the first flapper 312. The relatively small volume of water from compartment A drains through the first flapper valve housing, the L-shaped tube, the connector 320 and the second flapper valve housing to be discharged through the outlet shaft.

Notably, the higher vertical disposition of the first flapper valve permits the inherent water pressure within compartment A to flush while utilizing majority of the volume in the compartment. Due to the fact that the divider slot 62 allows fluid communication between the compartments, the back pressure of the water in compartment B flows water back into compartment A while compartment A is being drained, this action assists refilling of the tank until equilibrium has been reached. When the user desires to flush solid waste, the user operates the second handle 220 to open the second flapper valve via the second lever arm 222 lifting the second flapper 322.

The relatively large volume of water from compartment B drains through the second flapper valve housing to be discharged through the outlet shaft. It is noted that the above fluid flow between compartments will be present in this instance also except in reverse, i.e. water flows from compartment A to compartment B. There are occasions when the wastes may require more than the capacity of compartment B. For heavier loads, the user operates both handles to employ the full capacity of the tank.

The dual toilet tank system has many benefits for water conservation. Water conservation, especially potable water, is an important consideration for everyone in present day, not only in terms of financial costs but also as an environmental concern. As an example of how the present invention may promote water conservation, an individual or user may flush a toilet five times a day using a conventional three gallon tank system, assuming four times for liquid wastes and one time for solid waste. That amounts to 15 gallons of water per day or 5,475 gallons per year. In contrast, the dual toilet tank system of three gallon capacity would use 6 gallons per day (4 gallons total for liquid wastes and 2 gallons for solid wastes) or 2,160 gallons per year, a savings of 3,315 gallons over the course of the year.

It should be noted that the present invention may encompass a variety of alternatives to the various features thereof. For example, the flushing valve system may be formed from PVC pipes, plastics or other sturdy materials. With respect to the divider, the inner walls of the tank may be provided with elongate slots for the divider to be inserted into the tank. The divider may also be provided with holes 64 to induce additional or faster fluid flow between the compartments. These holes may be selectively corked. With respect to the flushing valve assembly, the tubing therein may be separate pieces or integrally formed, e.g. the connector may be threaded or adhesively connected to the first flapper valve and the overflow tube.

It is envisioned that the dual toilet tank system may be used to replace standard toilet tanks. In which case, the dual toilet tank system unit would be a pre-assembled package containing the elements shown in FIG. 2 with the appropriate mounting hardware. It is also envisioned that the flushing valve system may be provided in a separate package to replace worn or faulty flushing valve system in an existing toilet.

It is to be understood that the present invention is not limited to the embodiments described above, but encompasses any and all embodiments within the scope of the following claims.

I claim:

1. A dual toilet tank system, comprising:

a tank including a tank body, the tank body having at least opposing front and back walls and a bottom for holding a volume of fluid;

a refilling assembly operably connected to the tank;

a divider insertably mounted in the tank in between and touching the opposing front and back walls and the bottom, separating the tank into first and second compartments and providing fluid communication therebetween, a volume of the first compartment being substantially smaller than a volume of the second compartment;

wherein the divider has an open slot disposed therethrough at the bottom of the divider so that the divider may be inserted between the first and second flapper valves and permit said fluid communication between the first and second compartments via the open slot when it is mounted in the tank;

a flushing valve assembly having an inlet end and an outlet end and first and second flapper valves, the first flapper valve being disposed vertically higher than the second flapper valve with respect to the bottom of the tank;

a first actuator for selectively flushing fluid in the first compartment; and a second actuator for selectively flushing fluid in the second compartment, wherein the first and second actuators are independently actuated to drain fluid from each of the compartments or the tank.

2. The dual toilet tank system according to claim 1, wherein the refilling assembly comprises:

an inflow tube having one end connected to a fluid source;

a fluid flow control assembly disposed on the other end of the inflow tube; and a refill tube extending from said fluid flow control assembly.

3. The dual toilet tank system according to claim 2, wherein the fluid flow control assembly comprises:

an inflow valve;

an elongated float arm pivotably connected to the inflow valve; and a float disposed on the float arm, wherein draining and refilling fluid in the tank lowers and raises the float to thereby respectively open and close the inflow valve.

4. The dual toilet tank system according to claim 3, further comprising a filter tube adjacent said inflow tube.

5. The dual toilet tank system according to claim 2, further comprising a filter tube adjacent said inflow tube.

6. The dual toilet tank system according to claim 1, wherein the divider further has at least one hole formed therethrough, the at least one hole being disposed above said open slot.

7. The dual toilet tank system according to claim 1, wherein the divider has at least one opening formed therethrough.

8. The dual toilet tank system according to claim 7, wherein the at least one opening includes a slot for placement of the divider between the first and second flapper valves.

9. The dual toilet tank system according to claim 7, wherein the at least one opening includes a hole for providing fluid flow and communication between the first and second compartments.

10. The dual toilet tank system according to claim 1 wherein the first flapper valve is disposed in the first compartment and the second flapper valve is disposed in the second compartment.

11. The dual toilet tank system according to claim 10, wherein the flushing valve assembly further comprises:

an elongated overflow tube containing the inlet end of said flushing valve, the inlet end being operably connected to the refilling assembly, said first flapper valve extending laterally and perpendicularly from a longitudinal axis of the overflow tube at one side thereof, said second flapper valve extending laterally, opposite from said first flapper valve, and perpendicularly from the longitudinal axis of the overflow tube at the other side of the overflow tube; and a connector disposed between the first flapper valve and the overflow tube.

12. The dual toilet tank system according to claim 11, wherein said overflow tube has a connecting bore formed therethrough adjacent the bottom of the overflow tube and above the extension of the second flapper valve, said first flapper valve having a connecting bore formed therethrough, said connector fastening the overflow tube to the first flapper valve.

13. The dual toilet tank system according to claim 12 wherein the first flapper valve further comprises:

a first flapper valve housing having an open end and a closed end;

a cap defining the closed end of the first flapper housing;

a substantially L-shaped tube extending from said first flapper valve housing, said connecting bore for the first flapper valve being disposed at the juncture of the L-shape of the L-shaped tube; and a pivotable first flapper disposed on the open end of the first valve housing to selectively open and close the first flapper valve to thereby allow draining and filling of said first compartment.

14. The dual toilet tank system according to claim 13, wherein the second flapper valve further comprises:

a second flapper valve housing having an open end and an outlet shaft, said outlet shaft defining the outlet end of the flushing valve assembly; and a pivotable second flapper disposed on the open end of the second valve housing to selectively open and close the second flapper valve to thereby allow draining and filling of said second compartment, said outlet shaft being configured for mounting to a discharge passage of a toilet bowl, whereby fluid drained from either compartments flows out said outlet shaft.

15. The dual toilet tank system according to claim 1, wherein said first actuator further comprises:

a first handle adjacent the first compartment;

an elongated first lever arm extending from said first handle; and an adjustable chain with one end connected to a distal end of said first lever arm and the other end connected to the first flapper valve; said second actuator further comprising:

a second handle adjacent the second compartment;

an elongated second lever arm extending from said second handle; and an adjustable chain with one end connected to a distal end of said second lever arm and the other end connected to the second flapper valve.

* * * * *